US009402459B2

(12) United States Patent
Seuk

(10) Patent No.: US 9,402,459 B2
(45) Date of Patent: Aug. 2, 2016

(54) BELT LOOP ARRAY FOR A CARRY POUCH OR HOLSTER

(71) Applicant: Jo Won Seuk, Highland Falls, NY (US)

(72) Inventor: Jo Won Seuk, Highland Falls, NY (US)

( * ) Notice: Subject to any disclaimer, the term of this patent is extended or adjusted under 35 U.S.C. 154(b) by 0 days.

(21) Appl. No.: 14/604,392

(22) Filed: Jan. 23, 2015

(65) Prior Publication Data

US 2015/0208796 A1 Jul. 30, 2015

Related U.S. Application Data

(60) Provisional application No. 61/932,098, filed on Jan. 27, 2014.

(51) Int. Cl.
*A45F 5/00* (2006.01)
*A45F 5/02* (2006.01)

(52) U.S. Cl.
CPC ..... *A45F 5/021* (2013.01)

(58) Field of Classification Search
CPC ..... A45F 5/021; A45F 2003/144; A45F 5/02; A45F 5/00
See application file for complete search history.

(56) References Cited

U.S. PATENT DOCUMENTS 1,984,310 A * 12/1934 Lakritz ..... A41D 11/00 2/80
5,233,942 A * 8/1993 Cooper ..... A01K 27/008 119/792
5,395,023 A * 3/1995 Naymark ..... A45C 11/38 224/199
5,628,443 A * 5/1997 Deutsch ..... A45C 7/0086 150/113
5,967,391 A * 10/1999 Hunt ..... A01M 31/004 224/222
6,158,642 A * 12/2000 Herbage ..... A45F 5/021 224/240
7,490,358 B1 * 2/2009 Beck ..... A41D 13/0531 2/102
8,919,629 B2 * 12/2014 Moreau ..... A45F 5/004 2/66
2008/0257922 A1 * 10/2008 Cragg ..... A45F 5/02 224/269
2010/0032465 A1 * 2/2010 Moreau ..... A45F 5/004 224/660
2011/0240704 A1 * 10/2011 Smith ..... A45F 5/02 224/676
2013/0299544 A1 * 11/2013 Moreau ..... A45F 5/02 224/675

* cited by examiner

*Primary Examiner* — Brian D Nash
*Assistant Examiner* — Derek Battisti
(74) *Attorney, Agent, or Firm* — R. Tracy Crump

(57) ABSTRACT

A belt loop array for mounting a pouch or holster to waist belts of three or more different widths. The belt loop array consists of a plurality (five shown) of belt loop straps: a single intermediate strap, a pair of short straps and a pair of long straps, which are sewn or otherwise affixed to the back of a pouch or holster to form belt loops of three different widths. The loop straps are affixed to the pouch in a side by side arrangement with the intermediate strap interposed between the short loop straps and long loop straps.

4 Claims, 4 Drawing Sheets

BELT LOOP ARRAY FOR A CARRY POUCH OR HOLSTER

This application claims the benefit of U.S. Provisional Application No. 61/932,098 filed Jan. 27, 2014, the disclosure of which is hereby incorporated by reference.

This invention relates to pouches and holsters for carrying personal items on a belt, and in particular a belt loop array for accessory carry pouches and holsters.

BACKGROUND AND SUMMARY OF THE INVENTION

Waist belt mounted pouches and holsters have been developed to carry a variety of personal items. For example, personal electronic devices, such as, cell phones, cameras, radios and digital music players are often carried in pouches attached to a user's belt. Law enforcement personnel and first responders routinely carry weapons, ammunition magazines, radios, and other duty equipment in pouches and holsters attached to their duty belts. Carpenters, electricians and other construction works carry tools in pouches attached to utility belts. Typically, these pouches and holsters are supported on a waist belt by passing the belt through one or more belt loops affixed to the back of the pouch or holster. While belt loops can be dimensioned to accept the wide range of belt widths, when used with a smaller width belt, the pouch or holster is prone to shift and tilt on the belt. In many applications, any shift or tilt of a carry pouch is undesirable. Consequently, belt loops must be specifically sized to match the particular belt width in order to securely support the pouches.

The present invention seeks to provide a belt loop array for mounting a pouch or holster to waist belts of three or more different widths. The belt loop array consists of a plurality (five shown) of belt loop straps: a single intermediate strap, a pair of short straps and a pair of long straps, which are sewn or otherwise affixed to the back of a pouch or holster to form belt loops of three different widths. The loop straps are affixed to the pouch or holster in a side by side arrangement with the intermediate strap interposed between the short loop straps and the long loop straps. The smallest width belt for which belt loop array is configured is securely held by only the short loop straps where the smallest width belt passes under all five loop straps. The largest width belt for which belt loop array is configured is securely held by only the long loop straps where the belt passes under long loop straps, but over the short loop straps and the intermediate loop strap. The intermediate width belt for which belt loop array is configured is secured by the single intermediate loop strap centered in the array where the belt passes under the long loop straps and the intermediate loop strap, but over the short loop straps. The arrangement and orientation of the loop straps within the belt loop array prevents the pouch or holster from shifting or tilting about the belt as long as the belt passes under any loop straps that will accommodate that belt width.

The above described features and advantages, as well as others, will become more readily apparent to those of ordinary skill in the art by reference to the following detailed description and accompanying drawings.

BRIEF DESCRIPTION OF THE DRAWINGS

The present invention may take form in various system and method components and arrangement of system and method components. The drawings are only for purposes of illustrating exemplary embodiments and are not to be construed as limiting the invention. The drawings illustrate the present invention, in which.

DESCRIPTION OF THE PREFERRED EMBODIMENT

In the following detailed description of the preferred embodiments, reference is made to the accompanying drawings that form a part hereof, and in which is shown by way of illustration specific preferred embodiments in which the invention may be practiced. These embodiments are described in sufficient detail to enable those skilled in the art to practice the invention, and it is understood that other embodiments may be utilized and that logical, structural, mechanical, electrical, and chemical changes may be made without departing from the spirit or scope of the invention. To avoid detail not necessary to enable those skilled in the art to practice the invention, the description may omit certain information known to those skilled in the art. The following detailed description is, therefore, not to be taken in a limiting sense, and the scope of the present invention is defined only by the appended claims.

Figure 1:
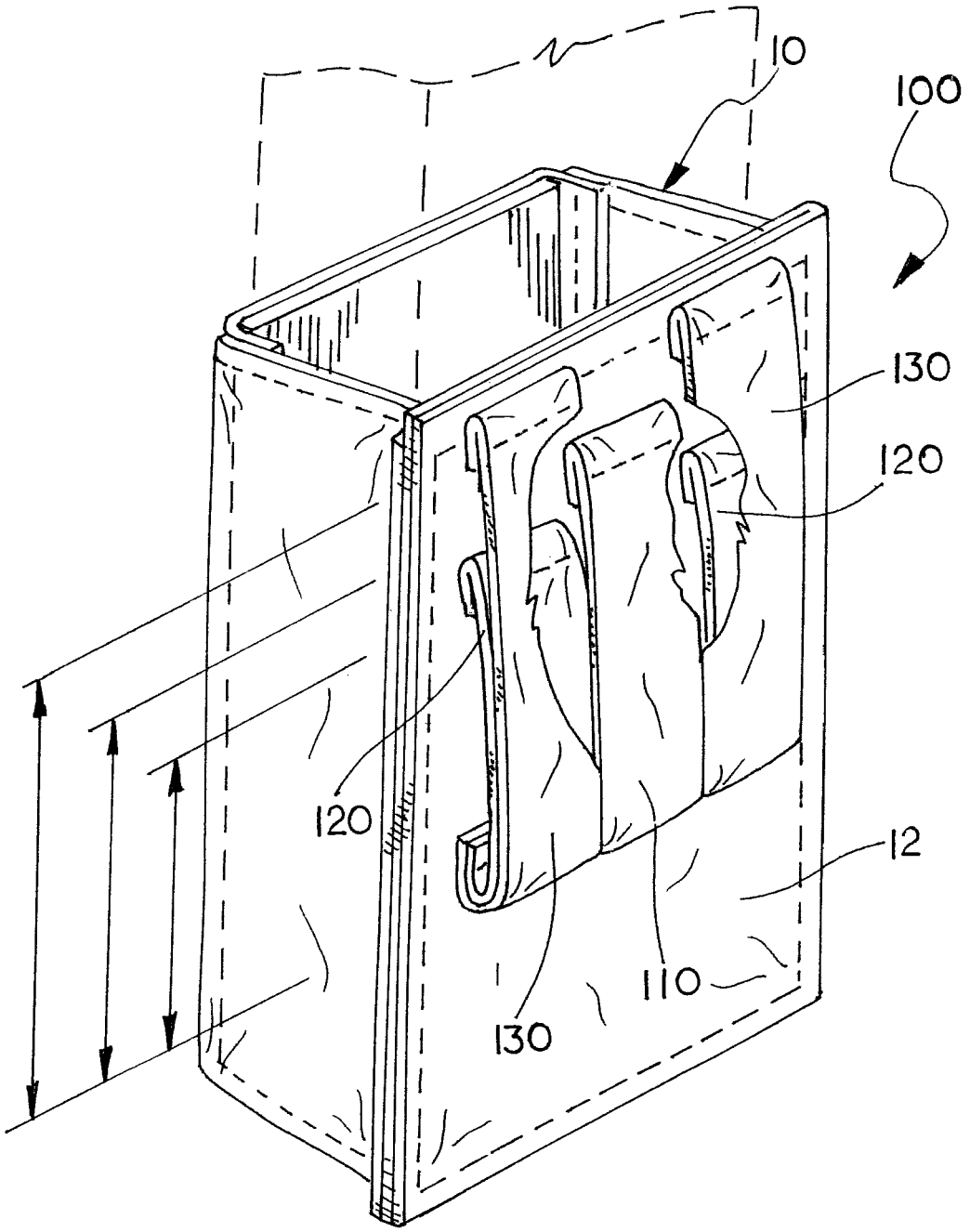
FIG. 1 is a perspective of an embodiment of a rifle magazine pouch using the belt loop array of this invention.
Figure 3:
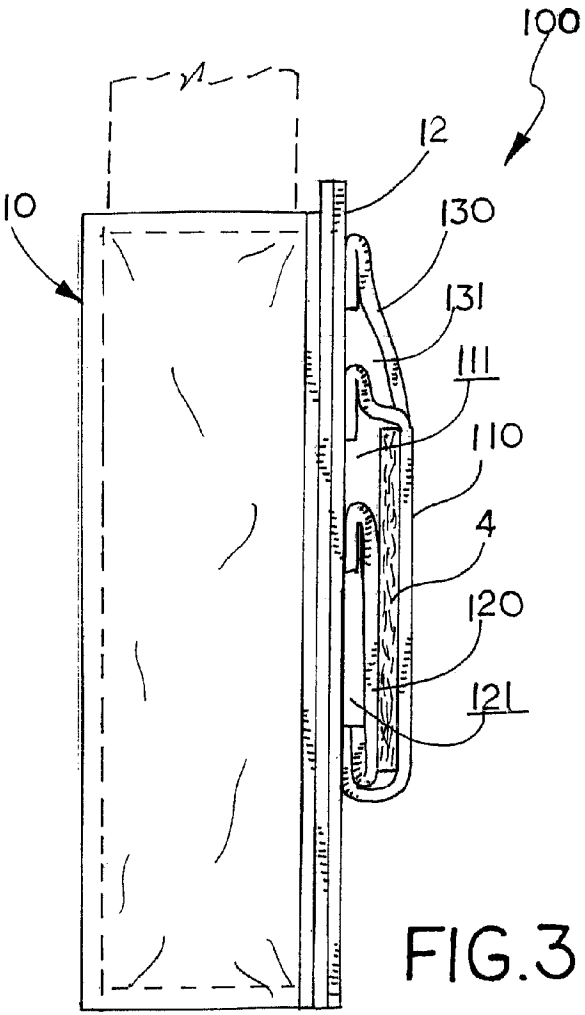
FIG. 3 is a side view of the pouch of FIG. 1 showing a belt extending under the intermediate loop strap.
Figure 4:
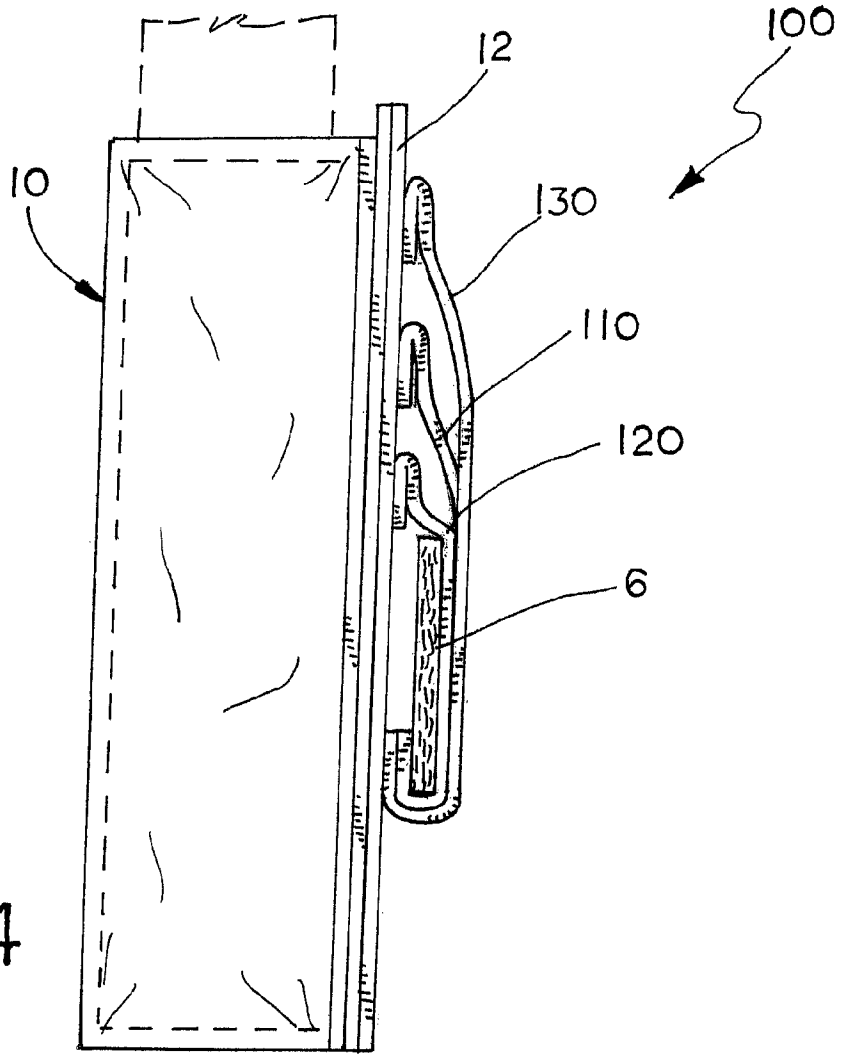
FIG. 4 is a side view of the pouch of FIG. 1 showing a belt extending under the short loop straps.
Figure 5:
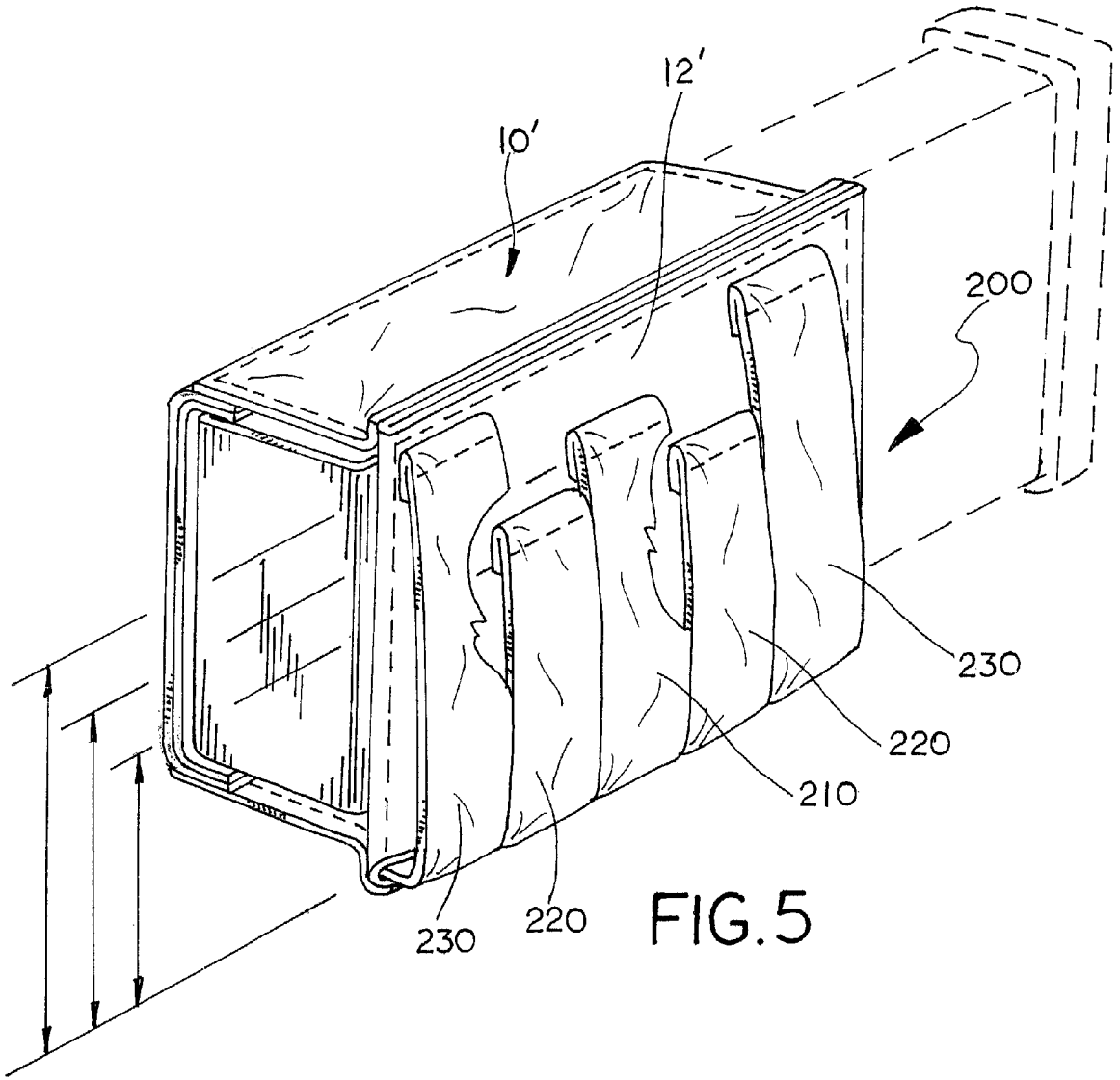
FIG. 5 is a perspective view of another embodiment of a rifle magazine using the belt loop array of this invention.

Referring now to the drawings, FIGS. 1-4 illustrate a first embodiment of a carry pouch 10 using belt loop array 100 of this invention. For simplicity of illustration and explanation only, belt loop array 100 is illustrated in the drawings and described herein as part of a vertical load rifle magazine pouch of the type used for carrying an M-16/AR-15 rifle magazine 2. FIG. 5 shows another embodiment of a carry pouch using belt loop array 100 depicted as a horizontal load rifle magazine pouch. It should be noted that belt loop array 100 may be incorporated into any carry pouch or holster within the teaching of this invention. The design, configuration and construction of the pouches or holsters may vary within the teaching of this invention for use in enclosing and carrying any desired item. Typically, the belt loop array of this invention is best suited for pouches and holsters that are constructed of a durable fabric, such as a nylon, but may be modified for use with pouches and holster made of leather, cloth or other durable fabrics and materials.

As shown, belt loop array 100 consists of a plurality (five shown) of belt loop straps: a single intermediate strap 110, a pair of short straps 120 and a pair of long straps 130. The opposed ends of loop straps 110, 120 and 130 are sewn or otherwise affixed to back panel 12 of pouch 10 to form passages (belt loop passages) 111, 121 and 131 through which belts of three widths can pass. As shown, loop straps 110 and 120 are affixed to pouch 10 in a side by side arrangement. Intermediate strap 100 is generally centered on back 12 of pouch 10 interposed between short loop straps 120 and long loop straps 130. Long loop straps 130 overlies short loop straps 120. The bottom ends of loop straps 120 and 130 are sewn together and affixed to back 12 of pouch 10. The bottom ends of loop straps 110, 120 and 130 are aligned while the top ends of the loop strap are spaced at different locations due to their different lengths. Each loop strap or pair of loop straps

110, 120 and 130 has a length to form belt loops 111, 121, and 131 which each accommodates one of three different belt widths. For example, belt loop array 100 may be configured for three belt widths, namely 1", 1.5" and 1.75." As such, intermediate loop strap 110 is dimensioned to securely receive the intermediate width belt 4, short loop straps 120 are dimensioned to securely receive the smallest width belt 6 and large loop straps 130 are dimensioned to securely receive the largest width belt 2.

Figure 2:
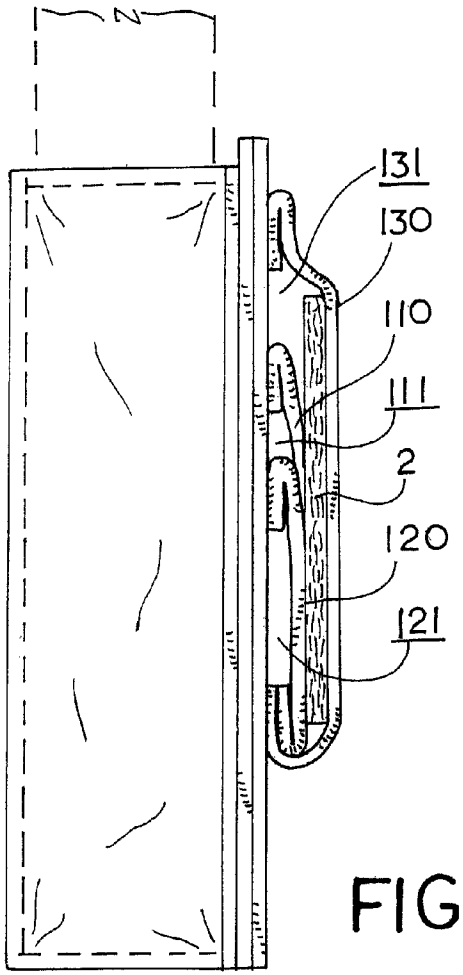
FIG. 2 is a side view of the pouch of FIG. 1 showing a belt extending under the long loop straps.

The arrangement and orientation of loop straps 110, 120 and 130 within belt loop array 100 prevents pouch 10 from shifting or tilting about the belt as long as the belt passes under any loop straps that will accommodate that belt width. The largest width belt 2 for which belt loop array 100 is configured is securely held by long loop straps 130 where the belt passes under long loop straps 130, but over short loop straps 120 and intermediate loop strap 110 (FIG. 2). The intermediate width belt 4 for which belt loop array 100 is configured is secured by the single intermediate loop strap centered in the array where the belt passes under long loop straps 130 and intermediate loop strap 110, but over short loop straps 120 (FIG. 3). The smallest width belt 6 for which belt loop array 100 is configured is securely held by only short loop straps 120 where the smallest width belt passes under all five loop straps 110, 120 and 130 (FIG. 4).

FIG. 5 shows another embodiment of a magazine pouch 10' using a second embodiment of the belt loop array of this invention, which is designated as reference numeral 200. Belt loop array 200 is similar in design and function to belt loop array 100 described above, except that the loop straps 210, 220 and 230 are all affixed to the back of the pouch in a side by side arrangement. The pair of long loop straps 230 do not overlap but are positioned adjacent the pair of short loop straps 220. As shown, loop straps 210, 220 and 230 are affixed to pouch 10' in a side by side arrangement. The bottom ends of loop straps 210, 220 and 230 are aligned while the top ends of the loop strap are staggered due to their different lengths.

It should be apparent from the foregoing that an invention having significant advantages has been provided. While the invention is shown in only a few of its forms, it is not just limited but is susceptible to various changes and modifications without departing from the spirit thereof. The embodiment of the present invention herein described and illustrated is not intended to be exhaustive or to limit the invention to the precise form disclosed. It is presented to explain the invention so that others skilled in the art might utilize its teachings. The embodiment of the present invention may be modified within the scope of the following claims.

I claim:

1. A belt loop array for attaching a carrier to a plurality of waist belt comprising:

a first elongated strap part having a top end affixed to the carrier and a bottom end affixed to the carrier and spaced a first distance from the top end thereof to form a first belt loop passage adapted for receiving a waist belt of a first width between the first strap part and the carrier;

a pair of second elongated strap parts each having a top end affixed to the carrier and a bottom end affixed to the carrier and spaced a second distance from the top end thereof to form a pair of second belt loop passages adapted for receiving a belt of a second width between the pair of second elongated strap parts and the carrier; and a pair of third elongated strap parts, each having a top end affixed to the carrier and a bottom end affixed to the carrier and spaced a third distance from the top end thereof to form a pair of third belt loop passages adapted for receiving a waist belt of a third width between the pair of third elongated strap parts and the carrier, the first elongated strap part interposed between and longitudinally aligned adjacent the pair of second elongated strap parts, the pair of second elongated strap parts interposed between and longitudinally aligned adjacent the pair of third elongated strap parts, the bottom ends of each of the first elongated strap part, the pair of second elongated straps parts and the pair of third elongated strap parts are affixed to the carrier to laterally align.

2. A belt loop array for attaching a carrier to a plurality of waist belts comprising:

a first elongated strap part having a top end affixed to the carrier and a bottom end affixed to the carrier and spaced a first distance from the top end thereof to form a first belt loop passage adapted for receiving a waist belt of a first width between the first strap part and the carrier;

a pair of second elongated strap parts each having a top end affixed to the carrier and a bottom end affixed to the carrier and spaced a second distance from the top end thereof to form a pair of second belt loop passages adapted for receiving a belt of a second width between the pair of second elongated strap parts and the carrier; and a pair of third elongated strap parts, each having a top end affixed to the carrier and a bottom end affixed to the carrier and spaced a third distance from the top end thereof to form a pair of third belt loop passages adapted for receiving a waist belt of a third width between the pair of third elongated strap parts and the carrier, the first elongated strap part interposed between and longitudinally aligned adjacent the pair of second elongated strap parts, the pair of third elongated strap parts are longitudinally aligned and overlie the pair of second elongated strap parts, the bottom ends of each of the first elongated strap part, the pair of second elongated straps parts and the pair of third elongated strap parts are affixed to the carrier to laterally align.

3. The belt loop array of claim 1 wherein the first distance is larger than the second distance and smaller than the third distance.

4. The belt loop array of claim 2 wherein the first distance is larger than the second distance and smaller than the third distance.

* * * * *